US007284493B2

(12) United States Patent
Morimoto

(10) Patent No.: US 7,284,493 B2
(45) Date of Patent: Oct. 23, 2007

(54) EASY-TO-OPEN SHEET PACKAGE BODY

(75) Inventor: Yoshinari Morimoto, Osaka (JP)

(73) Assignee: Pegasus Sewing Machine Mfg. Co., Ltd., Osaka (JP)

( * ) Notice: Subject to any disclaimer, the term of this patent is extended or adjusted under 35 U.S.C. 154(b) by 0 days.

(21) Appl. No.: 11/117,551

(22) Filed: Apr. 29, 2005

(65) Prior Publication Data

US 2005/0241555 A1 Nov. 3, 2005

(30) Foreign Application Priority Data

Apr. 30, 2004 (JP) ..... 2004-135814

(51) Int. Cl.
*D05B 5/00* (2006.01)
*D05B 23/00* (2006.01)

(52) U.S. Cl. ..... 112/438; 112/130

(58) Field of Classification Search ..... 112/418, 112/425, 436, 438, 441, 10, 11, 53, 162, 163, 112/197, 475.08; 206/524.1, 800, 820; 229/123.3, 229/309–311; 383/79, 200, 204, 205, 206
See application file for complete search history.

(56) References Cited

U.S. PATENT DOCUMENTS 1,809,103 A * 6/1931 Bates ..... 383/92
2,282,200 A * 5/1942 Neuman ..... 112/130
3,030,003 A * 4/1962 Roger ..... 383/79
3,747,743 A * 7/1973 Hoffmann, Jr. ..... 206/321
4,241,865 A * 12/1980 Ferrell ..... 383/204
4,441,582 A * 4/1984 Ward, Jr. ..... 182/48
4,509,280 A * 4/1985 Smith ..... 40/486
5,236,121 A * 8/1993 Wollman et al. ..... 229/76
5,515,800 A * 5/1996 Thompson ..... 112/475.09
5,518,313 A * 5/1996 McAdam ..... 383/4
5,722,336 A * 3/1998 Takeuchi ..... 112/441
6,129,264 A * 10/2000 Travers et al. ..... 229/72
6,159,423 A * 12/2000 Bourne et al. ..... 422/26
6,167,825 B1 * 1/2001 Marchetti ..... 112/162
6,332,418 B2 * 12/2001 Hayashi ..... 112/260
6,371,307 B1 * 4/2002 Eskes ..... 210/483

FOREIGN PATENT DOCUMENTS

JP 9-175564 7/1997

* cited by examiner

*Primary Examiner*—Ismael Izaguirre
(74) *Attorney, Agent, or Firm*—Bacon & Thomas, PLLC

(57) ABSTRACT

A sheet package body P has a first package body 1 and a second package body 2. The first package body 1 is disposed on the second package body 2 by overlapping in part, said overlapped portion L is set in a double chain stitch sewing machine and is sewn. A stitching D of chain stitch is formed said portion L. By pulling the sewing end portion 4*a* of the looper thread 4 forming the stitching D of chain stitch, the stitching D of chain stitch gradually unravels from the sewing end portion, and the both package bodies 1, 2 are separated from each other.

18 Claims, 20 Drawing Sheets

EASY-TO-OPEN SHEET PACKAGE BODY

BACKGROUND OF THE INVENTION

1. Field of the Invention

The present invention relates to an easy-to-open sheet package body for packaging a solid object.

2. Description of the Prior Art

Hitherto, as this kind of sheet package body, a cut tape has been widely used (see, for example, Japanese Patent Laid-Open Application No. H9-175564). A cut tape is adhered to the surface of a film package body for packaging an object, and by pulling a pull portion formed an end of the cut tape, the film package body is easily cut off along the cut tape.

SUMMARY OF THE INVENTION

In a conventional sheet package body, however, it has been difficult to use a cut tape in a commercial package paper. That is, the cut tape is adhered to the package body by fusing means or by using an adhesive agent, but the former is limited to the package body made of plastic material, and the latter is hard to cut neatly along the cut tape if the package body is made of paper material.

To solve these problems, the present invention as set forth in claim 1 is a sheet package body for packaging a solid object, being characterized by overlapping a first package body and a second package body in part, suturing the overlapped portion by stitching of a chain stitch, and cutting off the needle thread and looper thread at the sewing end of the stitching.

The present invention as set forth in claim 2 is a sheet package body for packaging a solid object, being characterized by butting a first package body and a second package body against each other side to side, suturing the butted portion by stitching of a chain stitch so as to enclose by needle thread rows, and cutting off the needle thread and looper thread at the sewing end of the stitching.

Preferably, the overlapped portion or butted portion is sutured with the tape material disposed at the lower side along said portion.

Preferably, the end of the looper thread cut off at the sewing end of the stitching is decorated with an ornament.

Specifically, the stitching is formed by engagement of two needle threads and a looper thread by using a double chain stitch sewing machine.

When using the double chain stitch sewing machine to the overlapped portion or butted portion, it is preferable formed to sew in one direction from one end to other end, or to sew from both ends toward the middle. At the sewing end position, sewing is once stopped, and the double chain stitch sewing machine is operated in a reverse rotation for one stitch, and the sewing is terminated by cutting off the needle thread and looper thread. More preferably, at the sewing end portion of the stitching, the sewing end portion of the looper thread projects to the surface side.

The first package body and second package body are made of paper material, cloth fabric or film plastic material.

According to the present invention, by pulling the sewing end portion of the looper thread, the stitching of chain stitch gradually unravels from the sewing end portion, and the first package body and second package body are separated from each other. The package body is made of commercial package paper or other sewable material, for example, paper material, cloth fabric, or film plastic material. The first package body and second package body may be made of different materials. The overlapped portion or butted portion of the first package body and second package body may be sutured in a state of disposing a tape material at the lower side along said portion, and the tape material reinforces the suture portion, and the decorative effect is obtained at the same time. Further, when an ornament such as ribbon is disposed at the sewing end portion of the looper thread, the ornament serves both as tip and as decoration, and it is more suited to gift applications.

BRIEF DESCRIPTION OF THE DRAWINGS

FIG. 10 is a perspective view showing a folded state of foldable message card.

FIG. 11 is a front view showing a folded state of foldable message card.

FIG. 12 is a perspective view showing amidst state of opening foldable message card.

FIG. 13 is a perspective view showing an opened state of foldable message card.

FIG. 14 is a development view of an outer surface of envelope sheet showing an example of sheet package body according to the present invention, which is applied in an envelope sheet.

FIG. 15 is a development view of an inner surface of envelope sheet.

FIG. 16 is a perspective view showing the midst state of folding envelope sheet.

FIG. 17 is a perspective view showing a sealed state of envelope sheet.

FIG. 18 is a front view showing a sealed state of envelope sheet.

FIG. 19 is a perspective view showing the midst state of opening a sealed envelope sheet.

FIG. 20 is a perspective view showing an opened state of envelope sheet.

DETAILED DESCRIPTION OF THE PREFERRED EMBODIMENT

Figure 3:
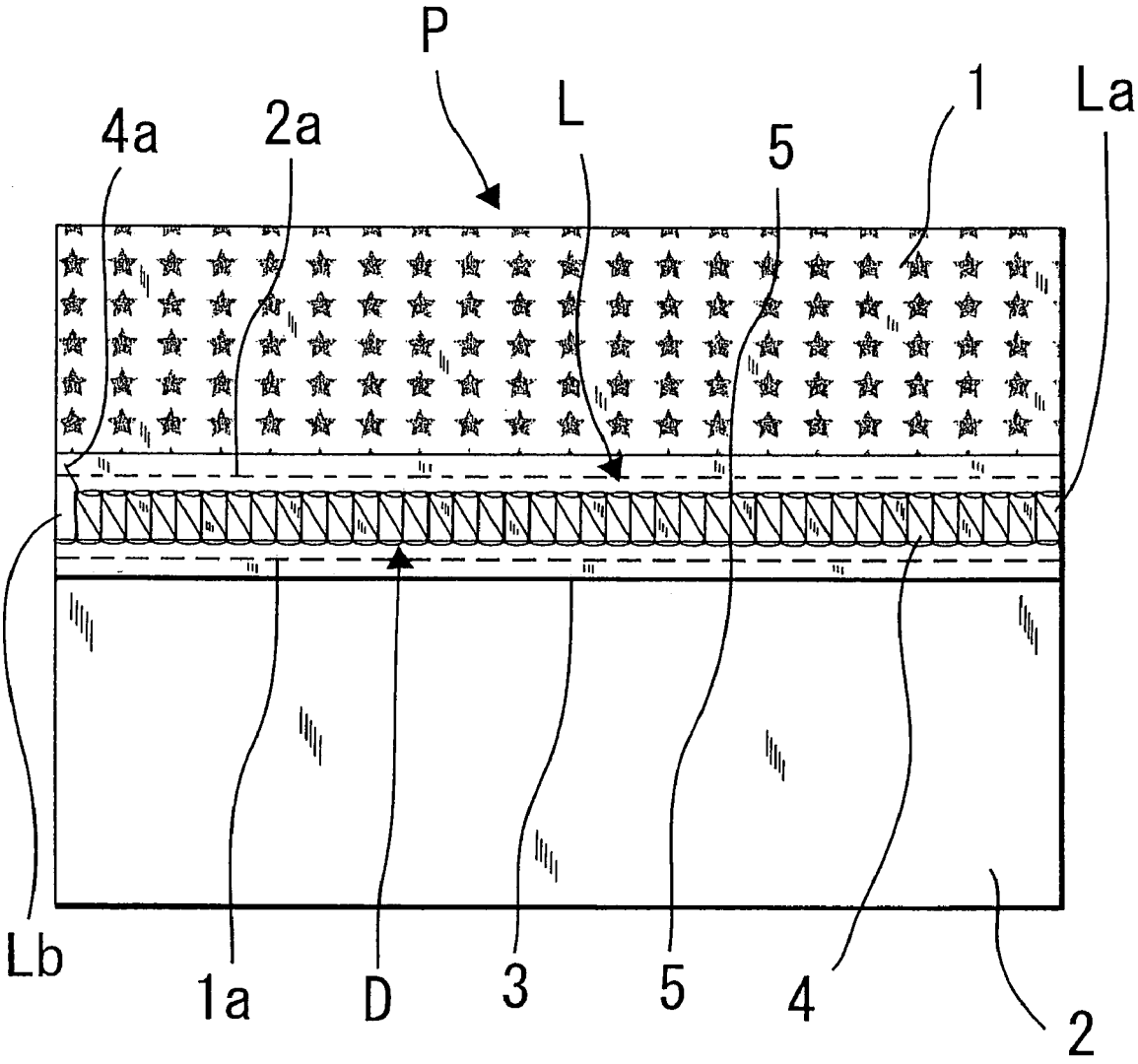
FIG. 3 is a development view of an outer surface showing an overlapping method of constituent members of the package body.

A preferred embodiment according to the present invention is described below while referring to the accompanying drawings. As shown in FIG. 3, a first package body 1 and a second package body 2 are rectangular paper members. Part of the first package body 1 overlaps to cover an end portion 2*a* of the second package body 2. A ribbon-shaped tape member 3 is disposed along the overlapped portion L of the both package bodies 1, 2 so as to cover the end portion 1*a* of the first package body 1 and the end portion 2*a* of the second package body 2. On the overlapped portion L, a stitching D of a chain stitch is formed along the longitudinal direction of the tape member 3, as a result, the second package body 2, first package body 1 and tape member 3 are sutured.

Figure 2:
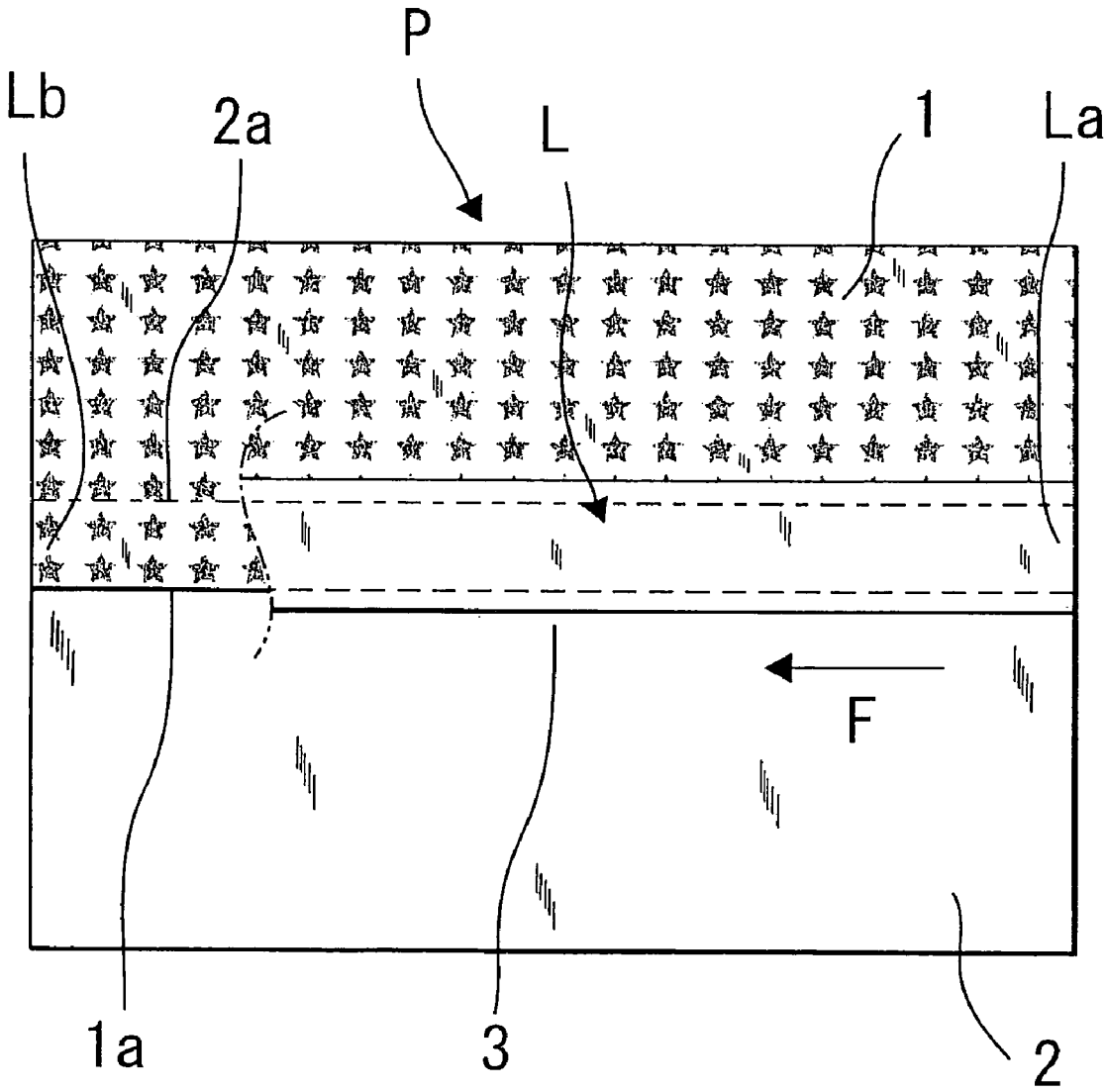
FIG. 2 is a development view showing an inner surface of sheet package body according to the present invention.
Figure 5:
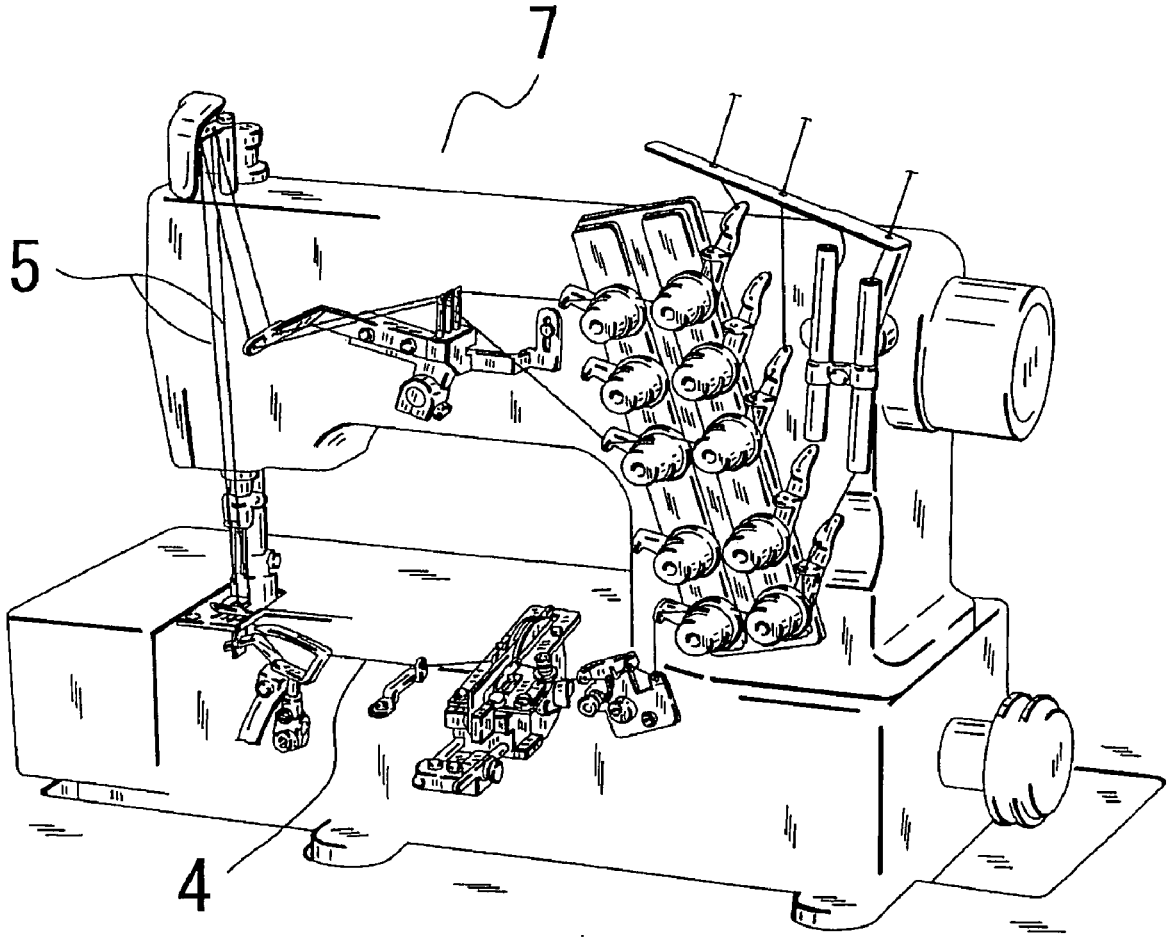
FIG. 5 is a perspective view showing essential parts of a double chain stitch sewing machine.

The stitching D of the chain stitch relates to stitch type 406 of JIS L 0120. The stitching D of the chain stitch is formed by engagement of two needle threads 5, 5 and a loop thread 4, by using a known double chain stitch sewing machine 7 as shown in FIG. 5. The forming method of stitching D of the chain stitch is explained by referring to FIG. 2 and FIG. 3. As mentioned above, the second package body 2, first package body 1, and the tape member 3 are overlapped (see FIG. 2), and set in the double chain stitch sewing machine 7. At this time, starting from the right side La of the overlapped portion L, the tape member 3 is set at the lower side. After setting, sewing starts in the direction of F. Once stopping sewing at the left side Lb of the overlapped portion L, the double chain stitch sewing machine 7 is operated in a reverse rotation for one stitch by known method, and the needle threads 5, 5 and looper thread 4 are cut off, and the sewing operation is terminated. At this time, in the sewing end portion of the stitching D of the chain stitch, the sewing end portion 4*a* of the looper thread 4 is projecting to the surface side of the tape member 3 as shown in FIG. 3.

Figure 1:
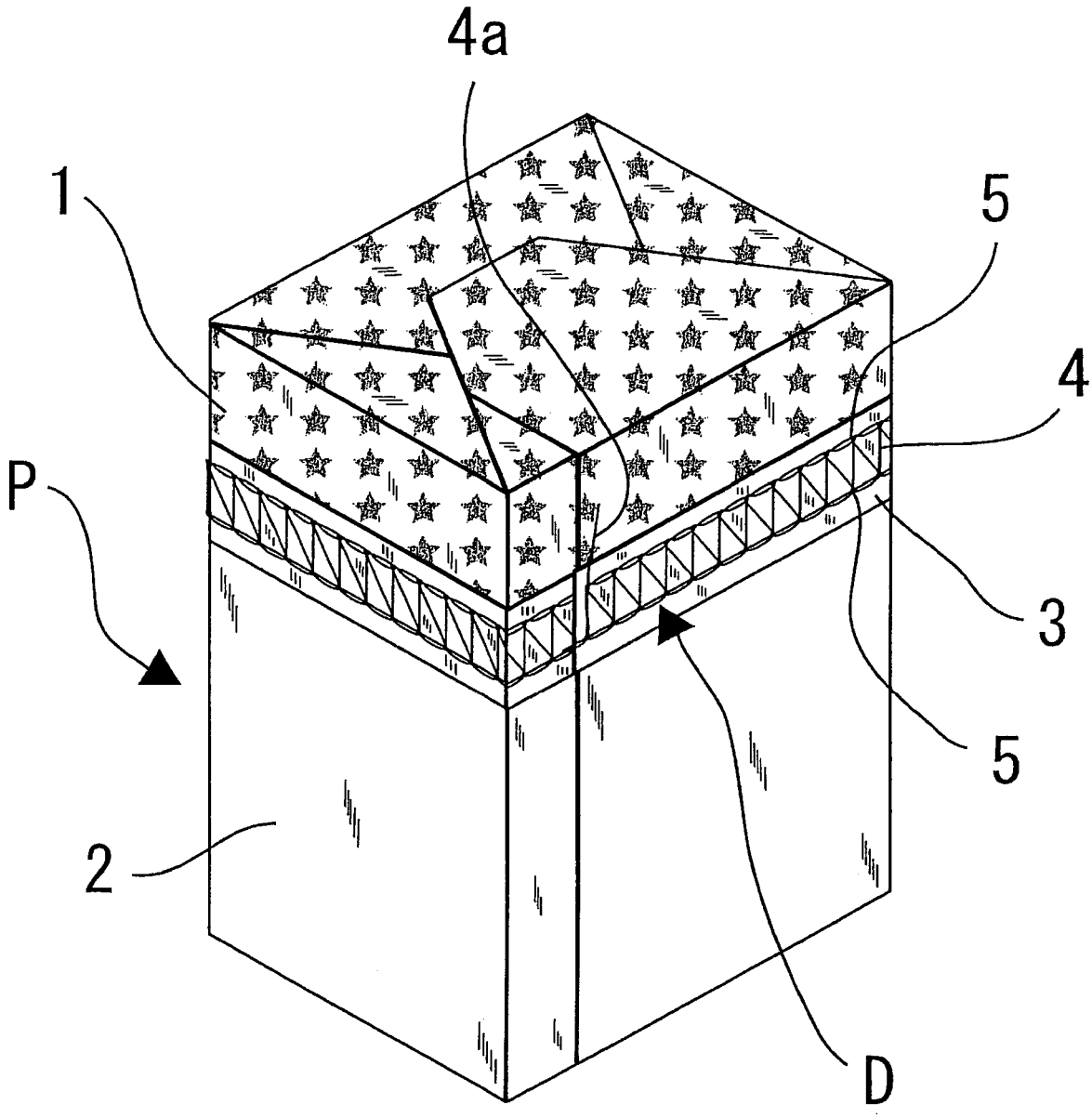
FIG. 1 is an essential perspective view of sheet package body showing an example of sheet package body according to the present invention, which is applied in a box-shaped object.
Figure 4:
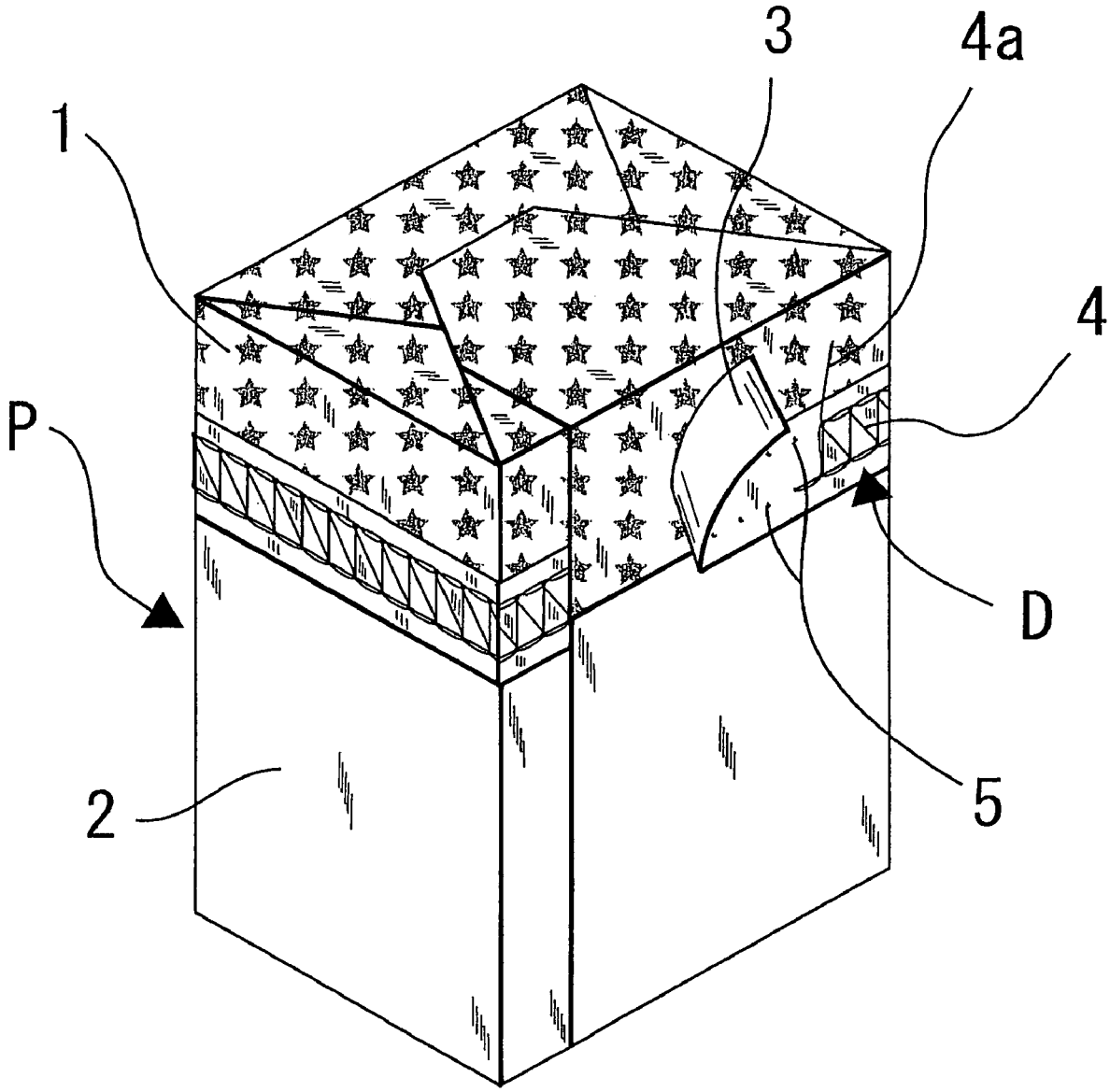
FIG. 4 is an essential perspective view showing an opening method in the application example in FIG. 1.

In FIG. 1, by pulling the sewing end portion 4*a* of the looper thread 4, the looper thread 4 gradually unravels as shown in FIG. 4, and the tape member 3, first package body 1 and second package body 2 are separated from each other. By attaching a ribbon or other ornament (not shown) to the sewing end portion 4*a*, the appearance of the package is improved, and it is easier to pinch and pull the sewing end portion 4*a*.

Figure 6:
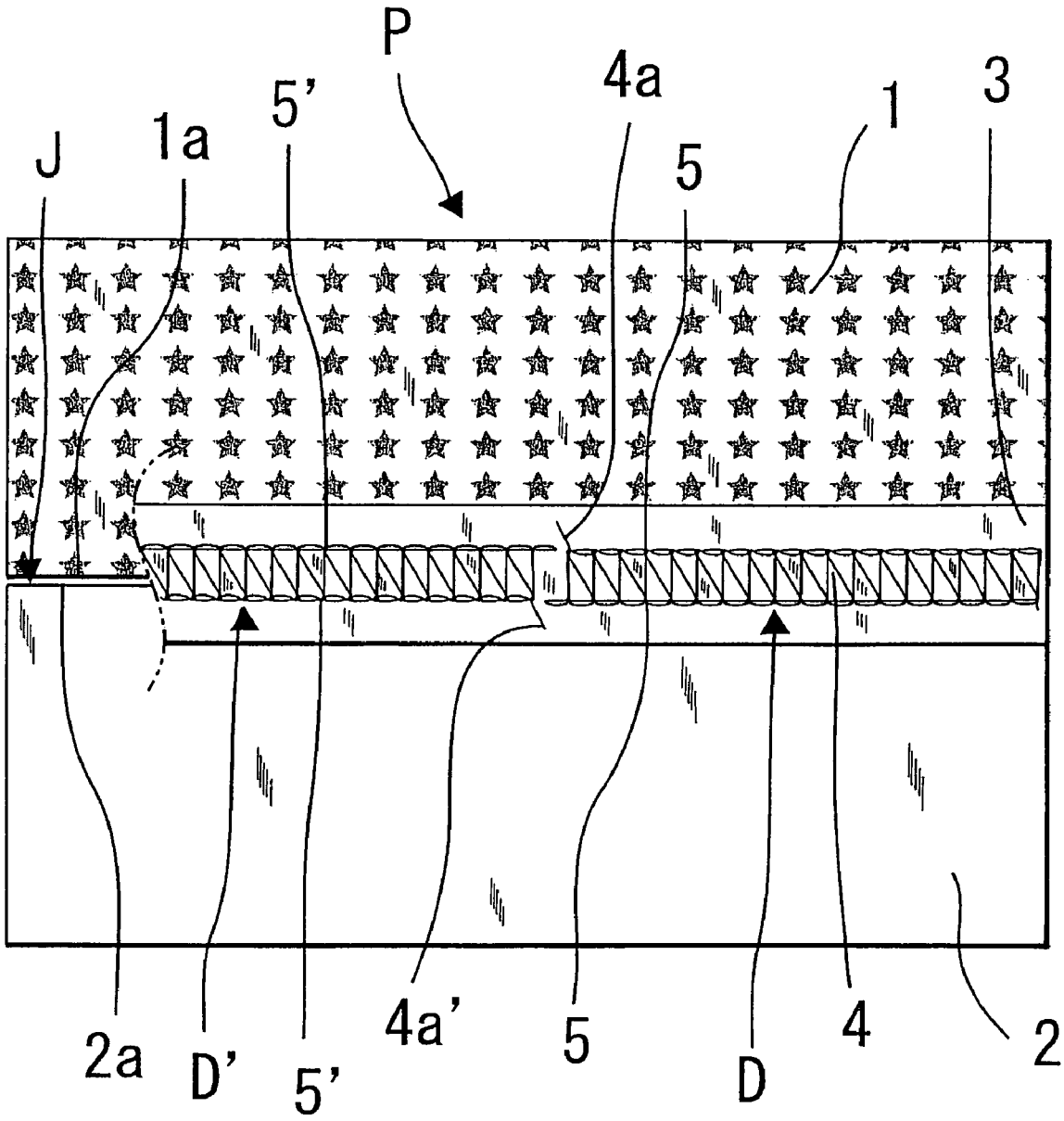
FIG. 6 is a development view of an outer surface showing other embodiment of sheet package body according to the present invention.
Figure 7:
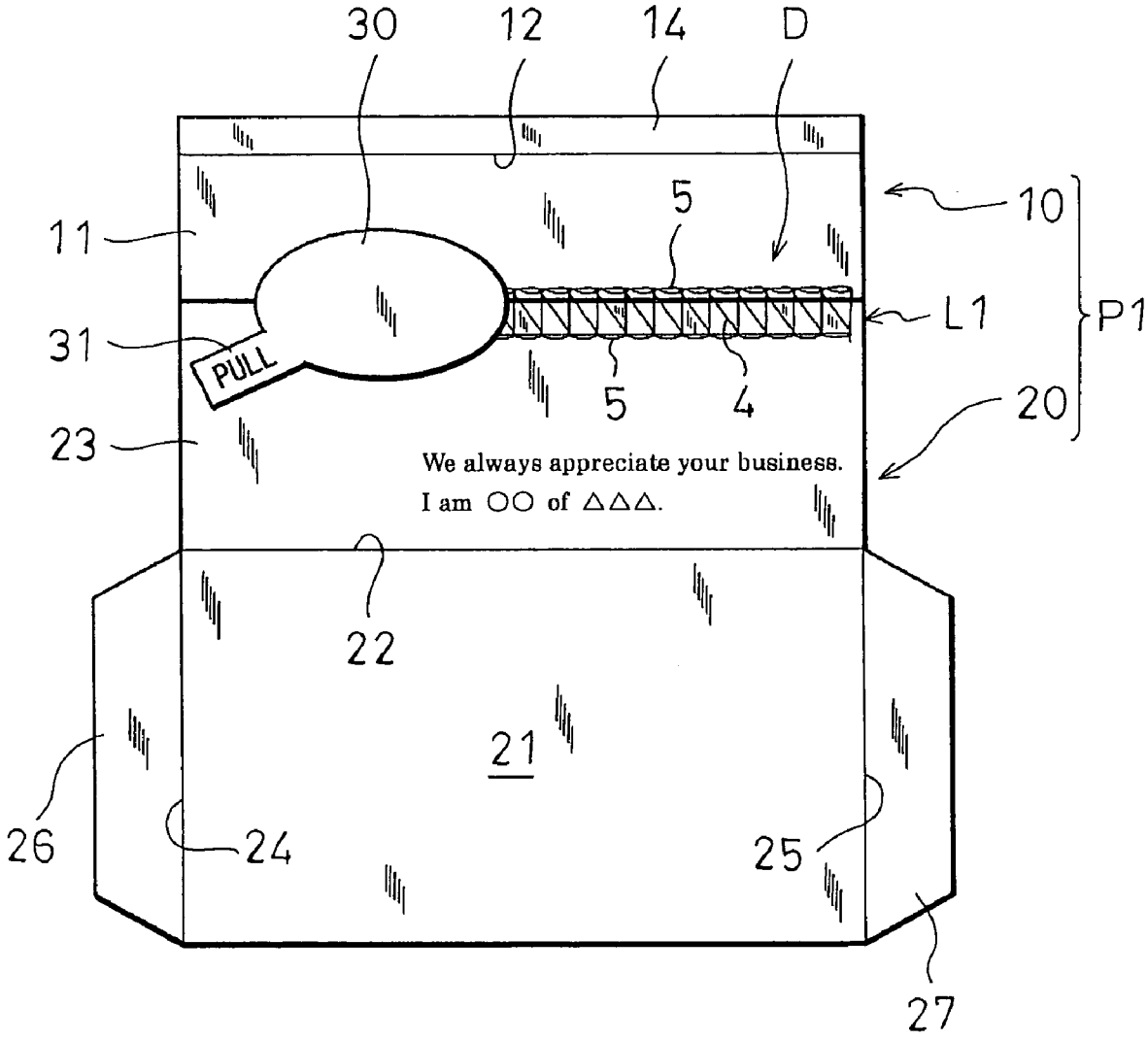
FIG. 7 is a development view of an outer surface of a foldable message card showing an example of sheet package body according to the present invention, which is applied in a foldable message card.

In the preferred embodiment, the first package body 1 and second package body 2 are overlapped in part, but they can be sutured together by the stitching of chain stitch without overlapping (see FIG. 6). A side 1*a* of the first package body 1 and a side 2*a* of the second package body 2 abut against each other, and the tape member 3 is disposed along the butted portion J. Two stitchings D, D' of chain stitch are formed so as to enclose the butted portion J by needle thread rows 5, 5 and 5', 5'. The stitchings D, D' of chain stitch are formed by sewing each from the end portion of the butted portion J with the tape member 3 disposed at the lower side, and sewing end portions 4*a*, 4*a*' of the stitchings D, D' of chain stitch are opposite to each other in the middle of the butted portion J. The sewing end portions 4*a*, 4*a*' are affixed to an ornament not shown. By pulling the ornament (not shown) of the sheet package body P thus formed, the sewing end portions 4*a*, 4*a*' gradually unravel toward the sewing start portions, and the tape member 3, first package body 1 and second package body 2 are separated from each other. When the first package body 1 and second package body 2 are made of a single material, the tape member 3 is properly disposed on the single package body, the stitchings D, D' of chain stitch are formed on the tape member 3, and the single package body is cut off into sides 1*a*, 2*a* as shown in FIG. 6, between needle thread rows 5, 5 and 5', 5' of the stitchings D, D' of chain stitch, so that the first package body 1 and second package body 2 can be formed.

Referring now to FIG. 7 to FIG. 13, other application example (a foldable message card) of the sheet package body according to the present invention is explained.

This foldable message card P1 is composed of a first package body 10 and a second package body 20, and a visiting card or other card object is contained between them. The second package body 20 includes a card reverse side 21 in a same shape as the card object C (see FIG. 9), a card surface half 23 linked to the upper edge of the card reverse side 21 by way of a fold 22, and right and left flaps 26, 27 consecutive to right and left edges of the card reverse side 21 by way of right and left folds 24, 25. The first package body 10 includes a card surface half 11 and a junction end 14. The junction end 14 is linked to the upper edge of the card surface half 11 by way of a fold 12, the inner surface of the junction end 14 has adhering means 13 formed by applying an adhesive agent or gluing both-side adhesive tape. The lower end of the card surface half 11 of the first package body 10 and the upper end of the card surface half 23 of the second package body 20 are overlapped, and this overlapped portion L1 is sutured by the stitching D of chain stitch from its end (right end in FIG. 7) toward other end (left end in FIG. 7). The sutured card surface halves 11, 23 compose the card surface in a same shape as the card reverse side 21. In this preferred embodiment, the stitching D of chain stitch is sutured from one end (right end in FIG. 7) of the overlapped portion L1 to slightly over the middle, and the sewing end portion 4*a* of the looper thread 4 cut off at the end of sewing projects to the outer surface side of the overlapped portion L1. The sewing end portion 4*a* of the looper thread 4 is bonded to the adhesion surface of a seal-form ornament 30. This ornament 30 is adhered to the outer surface of the card surface, straddling between the sewing end portion of the stitching D of chain stitch in the overlapped portion L1 and the card surface halves 11, 23 on the non-suture portion ahead of it. The seal-form ornament 30 disposes the sewing end portion 4*a* of the looper thread 4 at the outer surface side of the card surface, and couples the non-suture portions of the card surface halves 11, 23. In the ornament 30, further, a projecting tab 31 for pulling and peeling the ornament not adhered to the outer surface of the card surface is formed.

Figure 8:
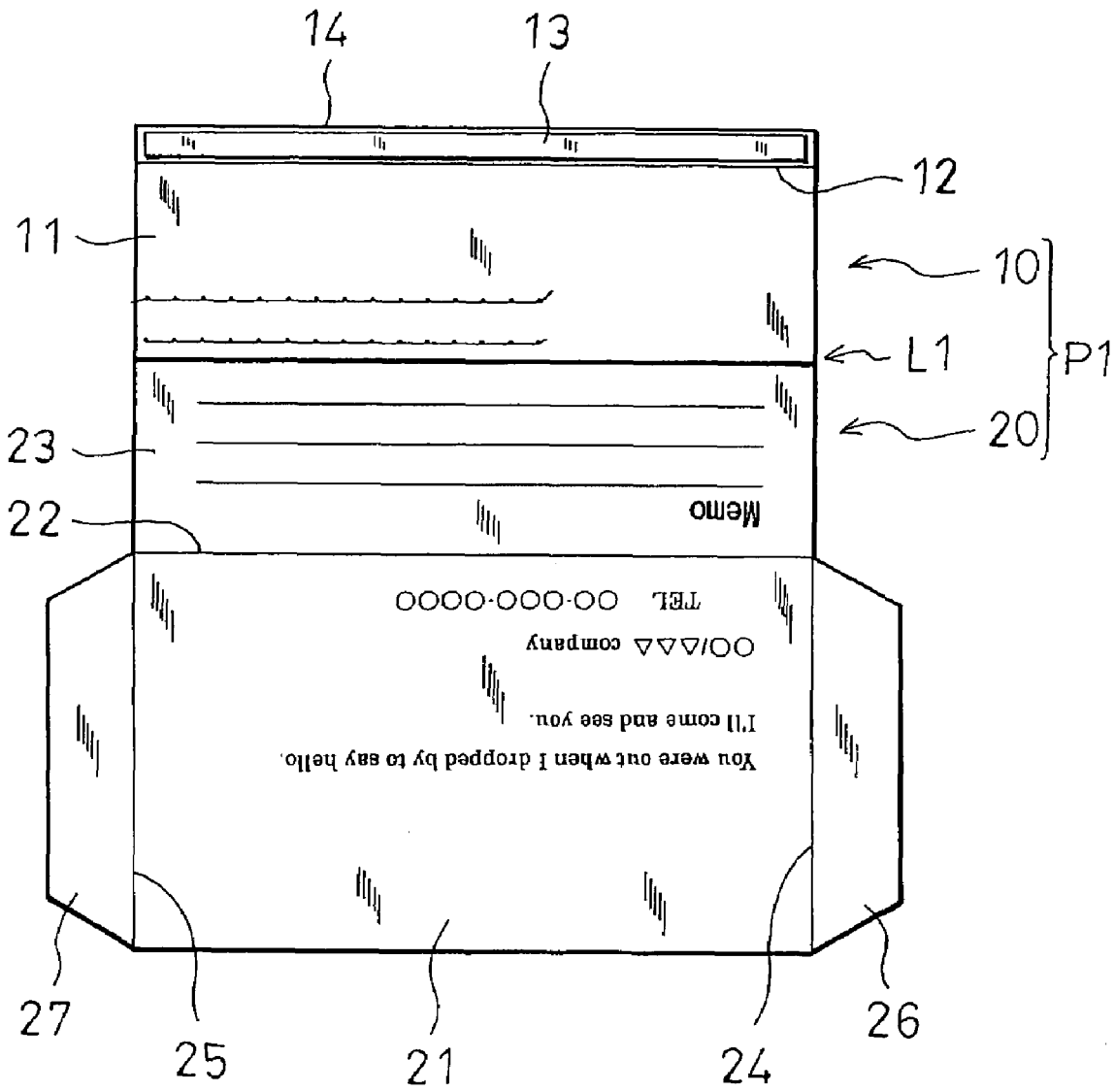
FIG. 8 is a development view of an inner surface of foldable message card.
Figure 9:
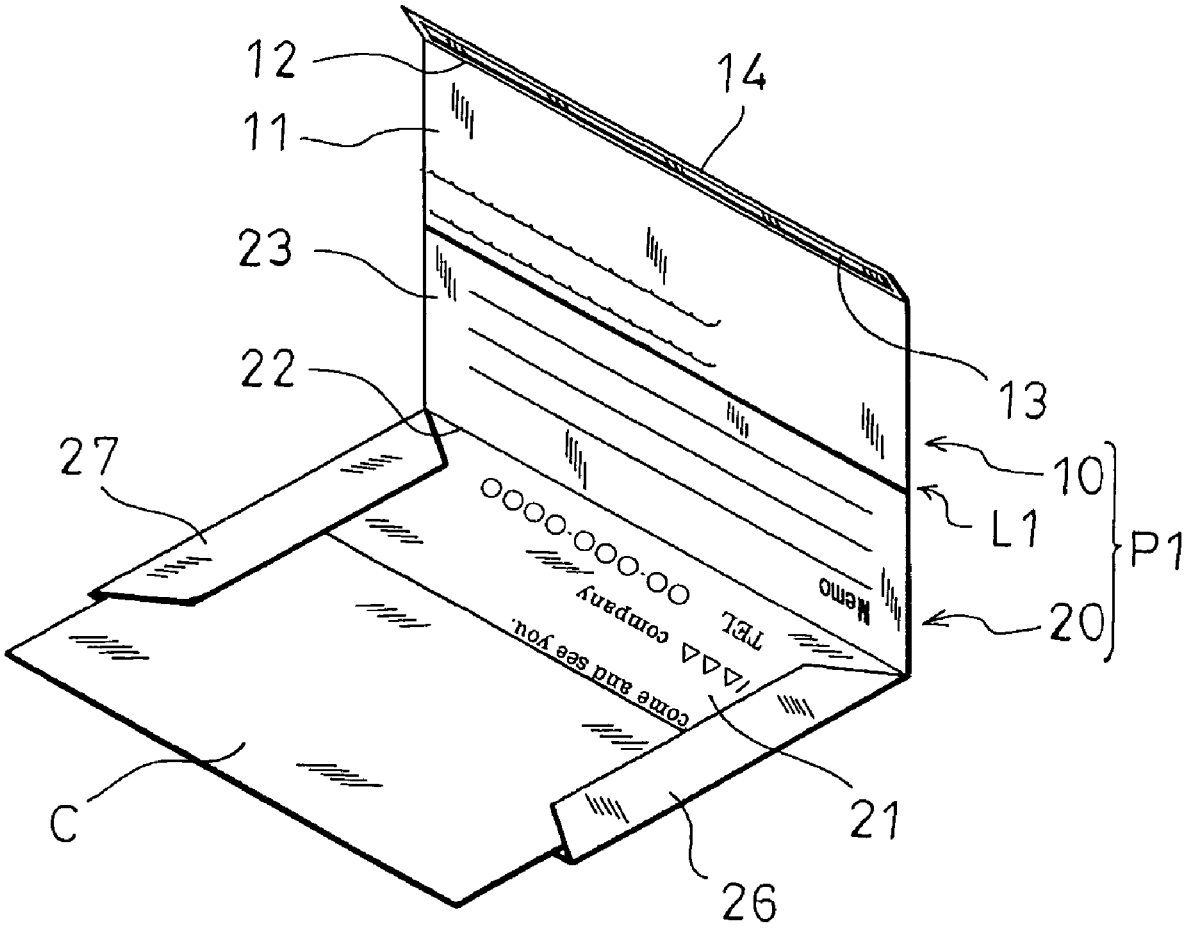
FIG. 9 is a perspective view showing amidst state of folding foldable message card.
Figure 1:
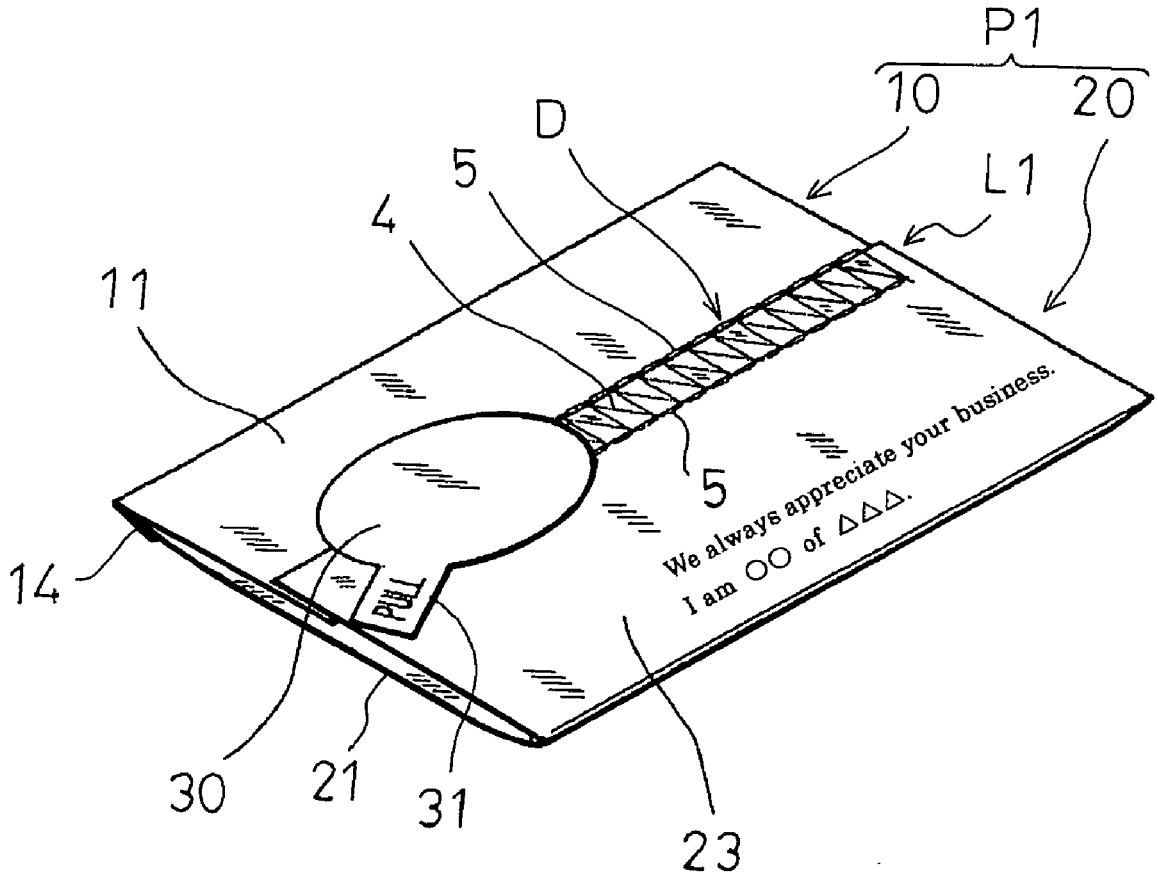
Figure 1:
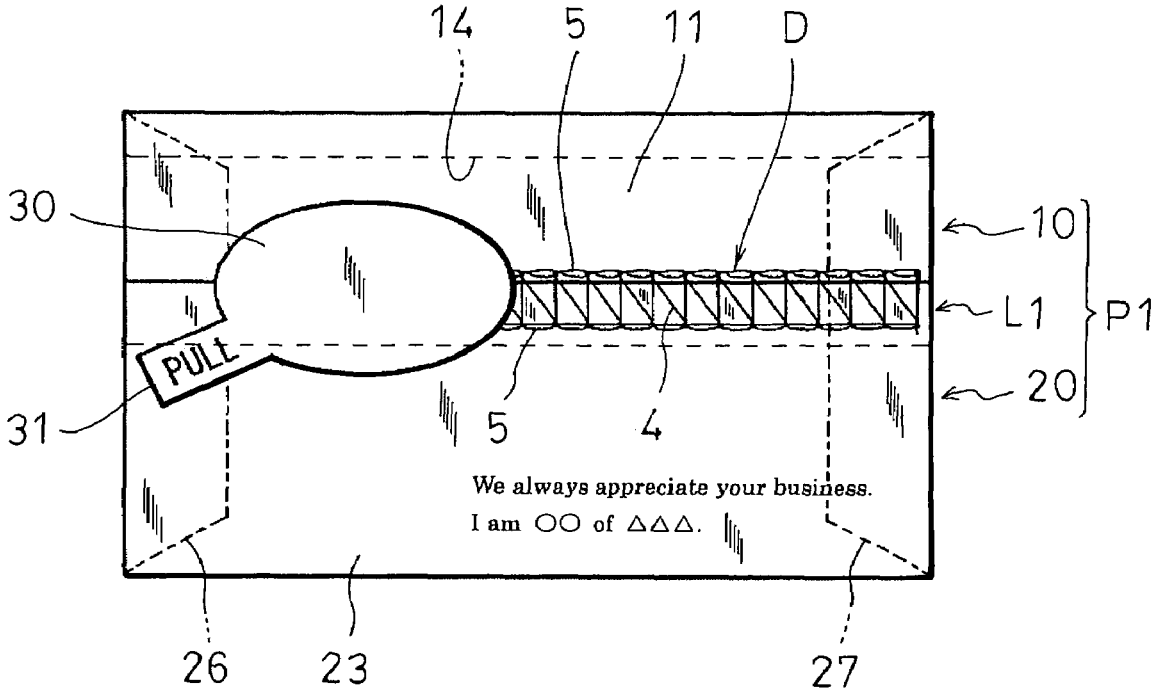
Figure 1:
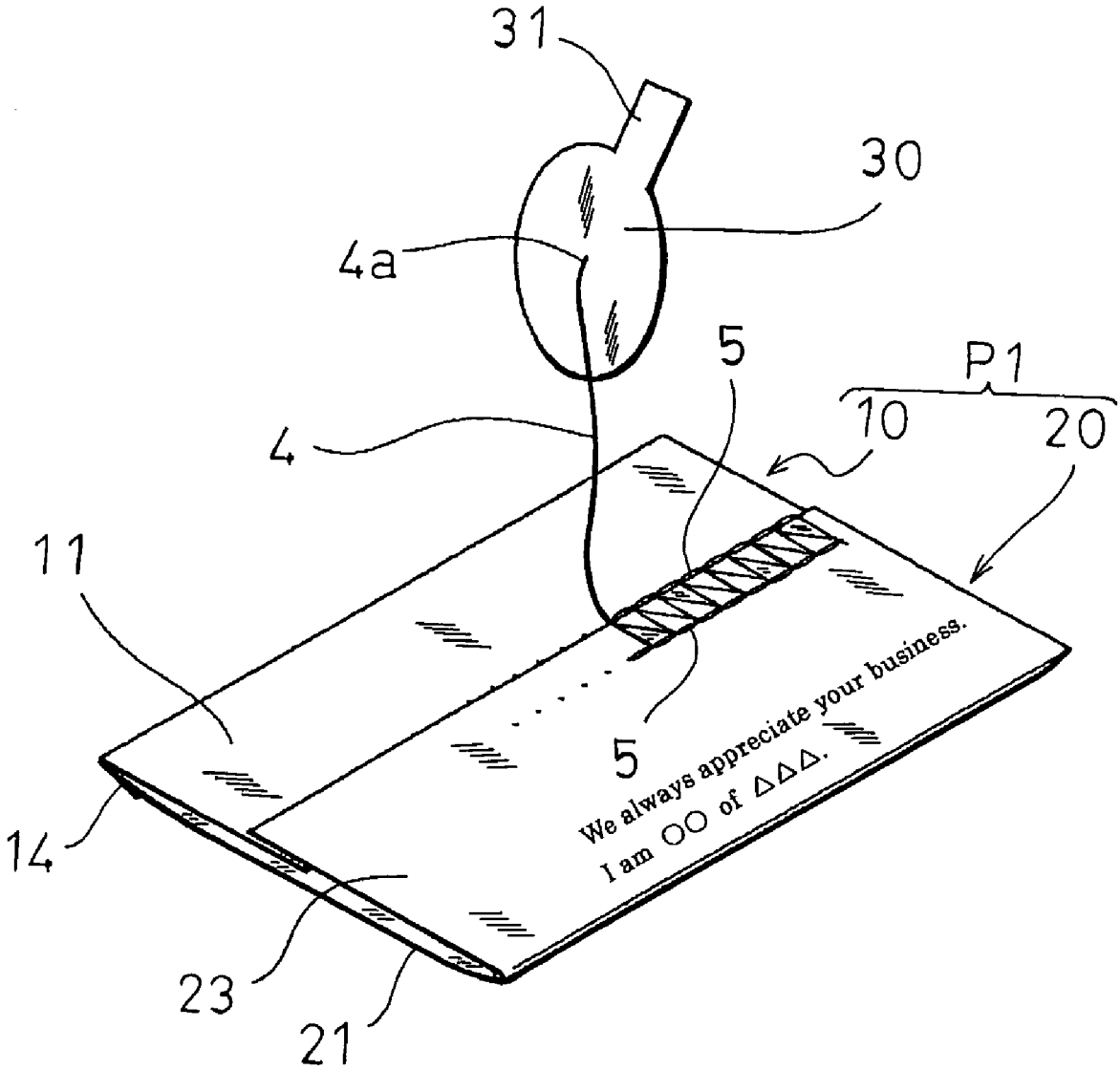
Figure 1:
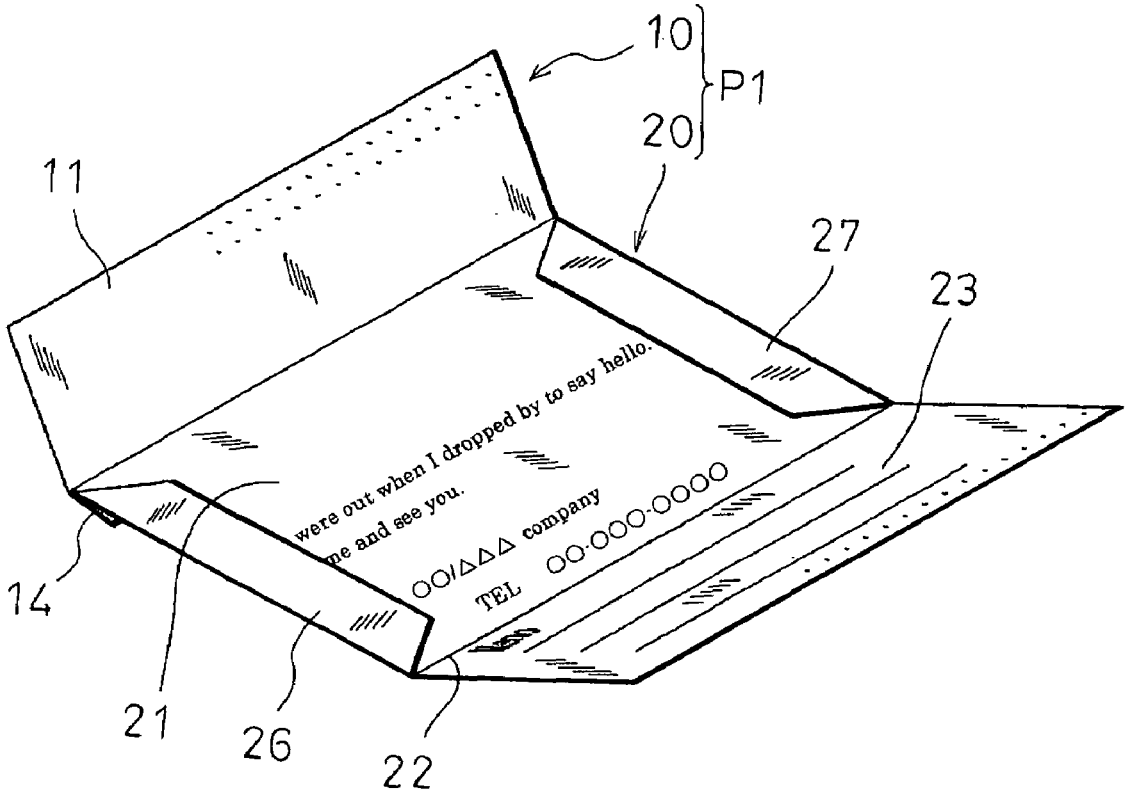
Figure 1:
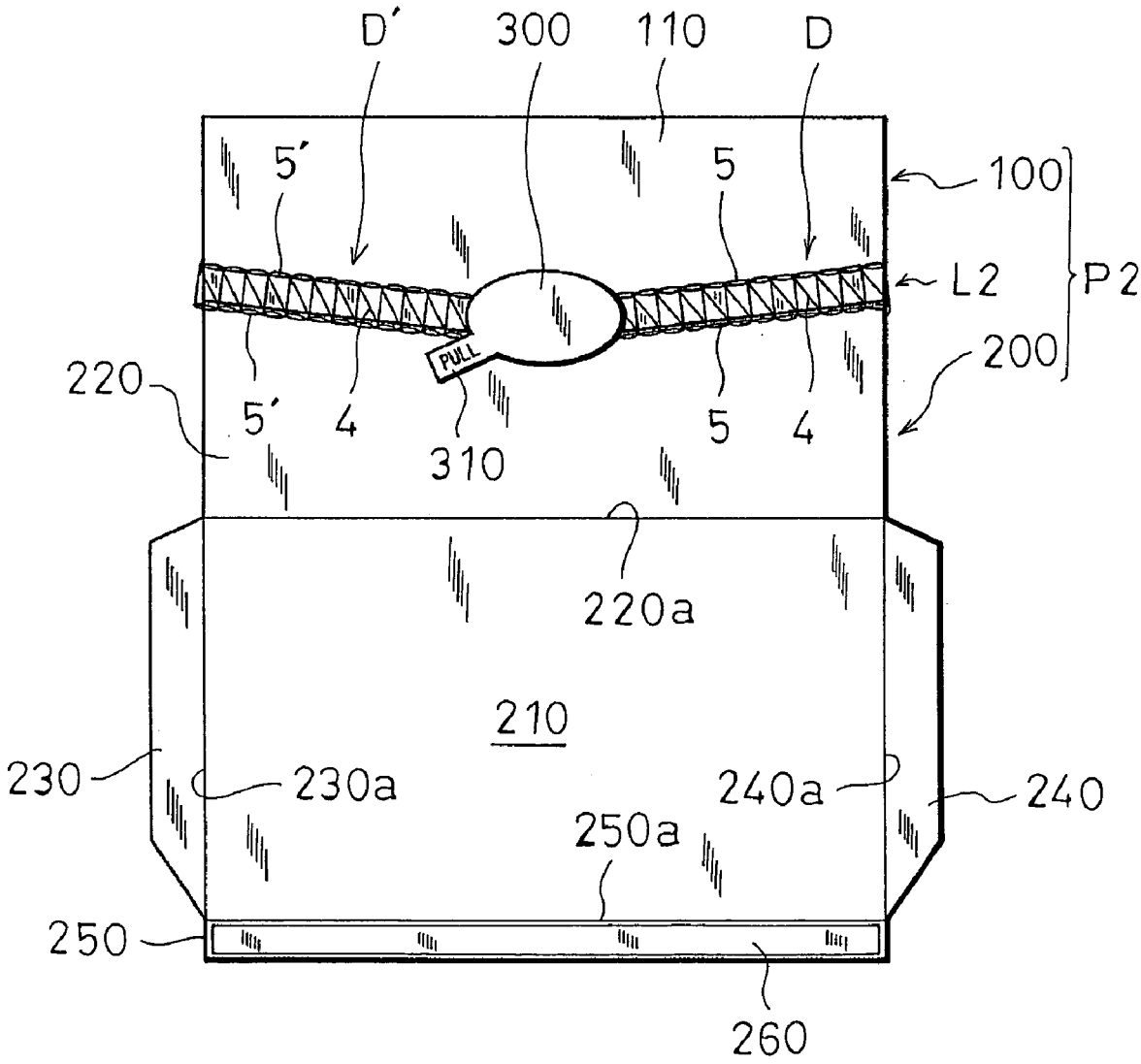
Figure 1:
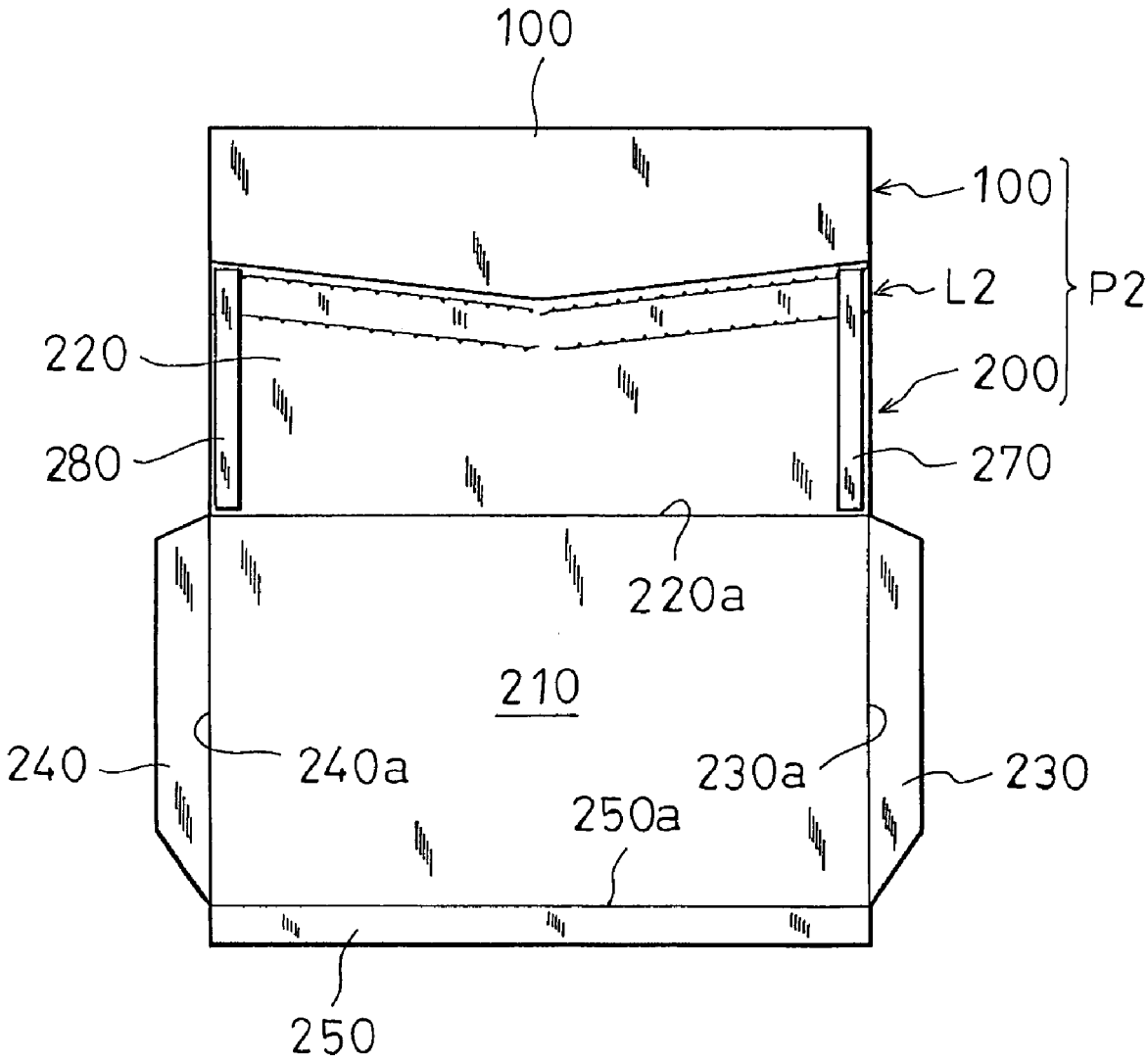
Figure 1:
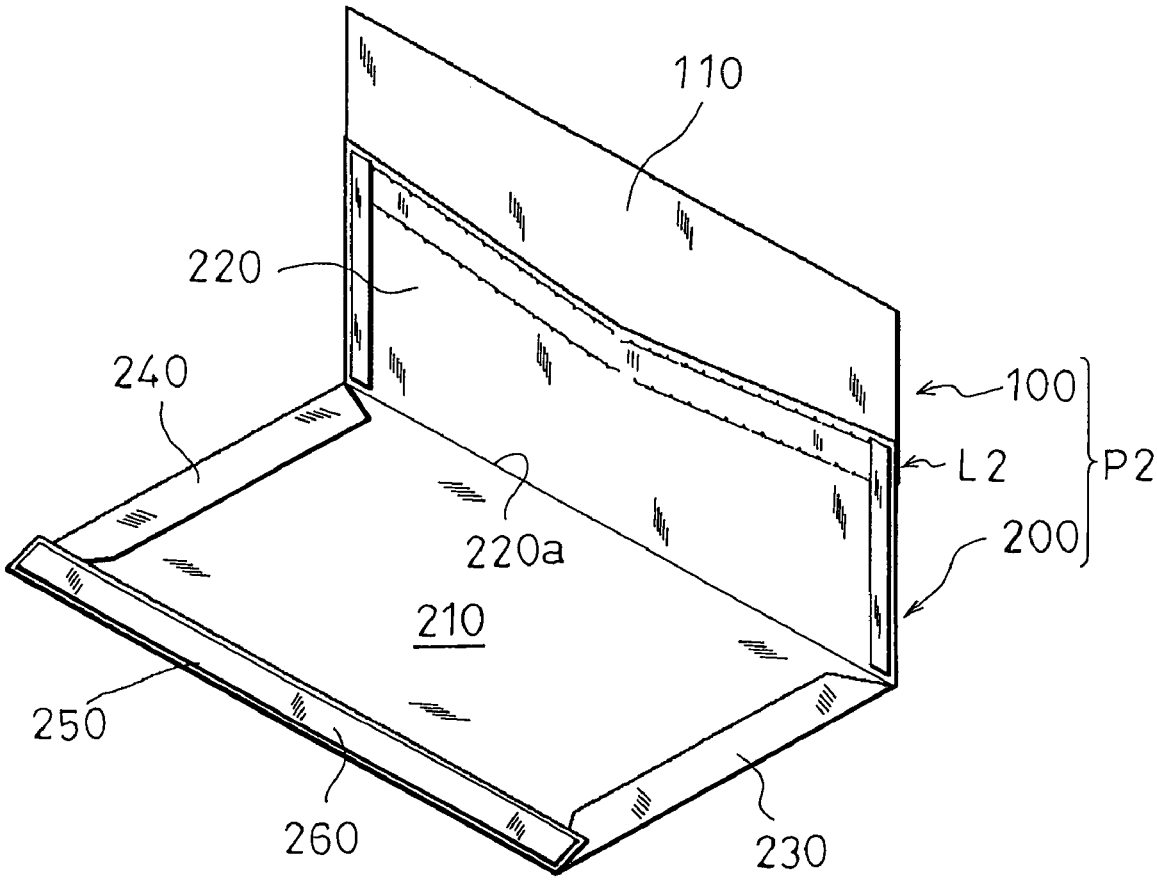
Figure 1:
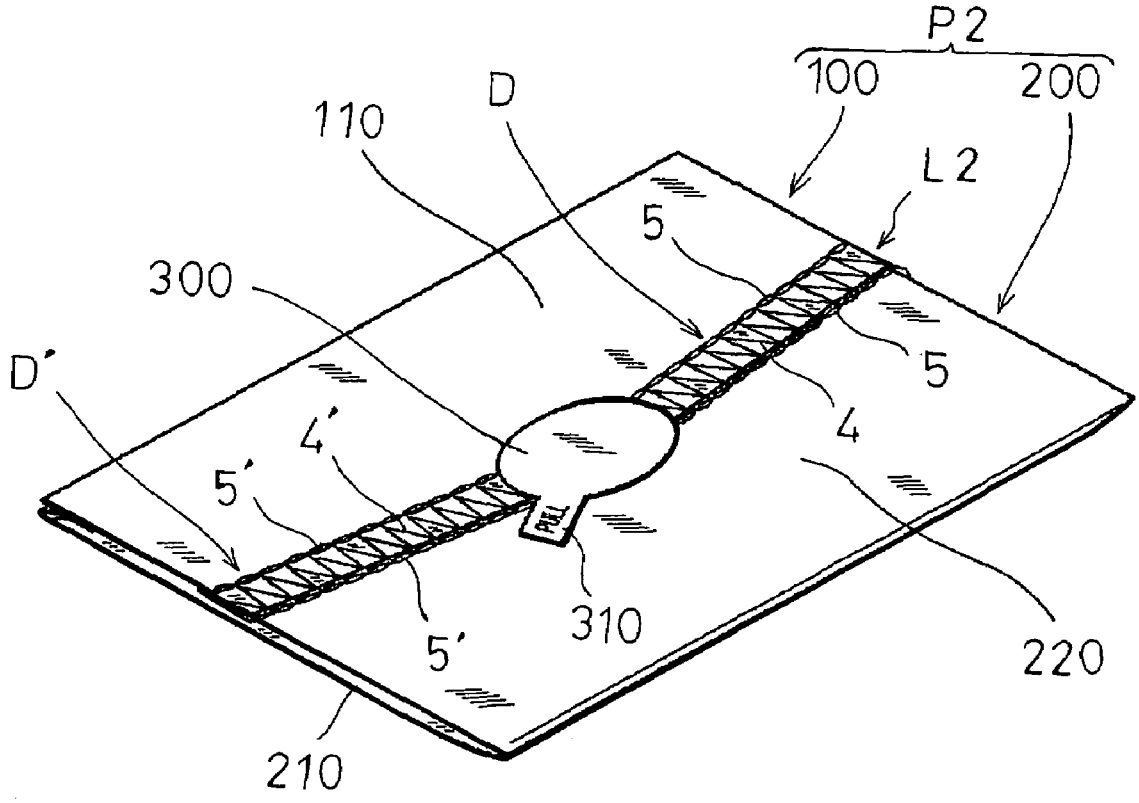
Figure 1:
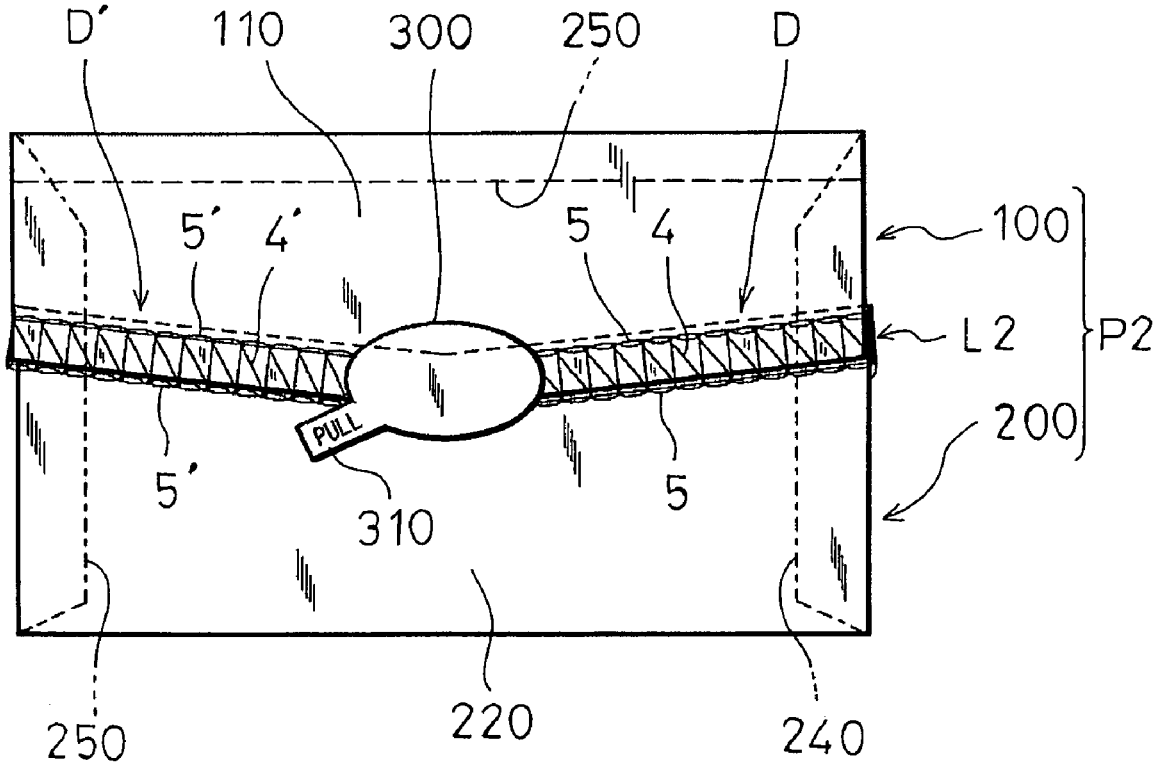
Figure 1:
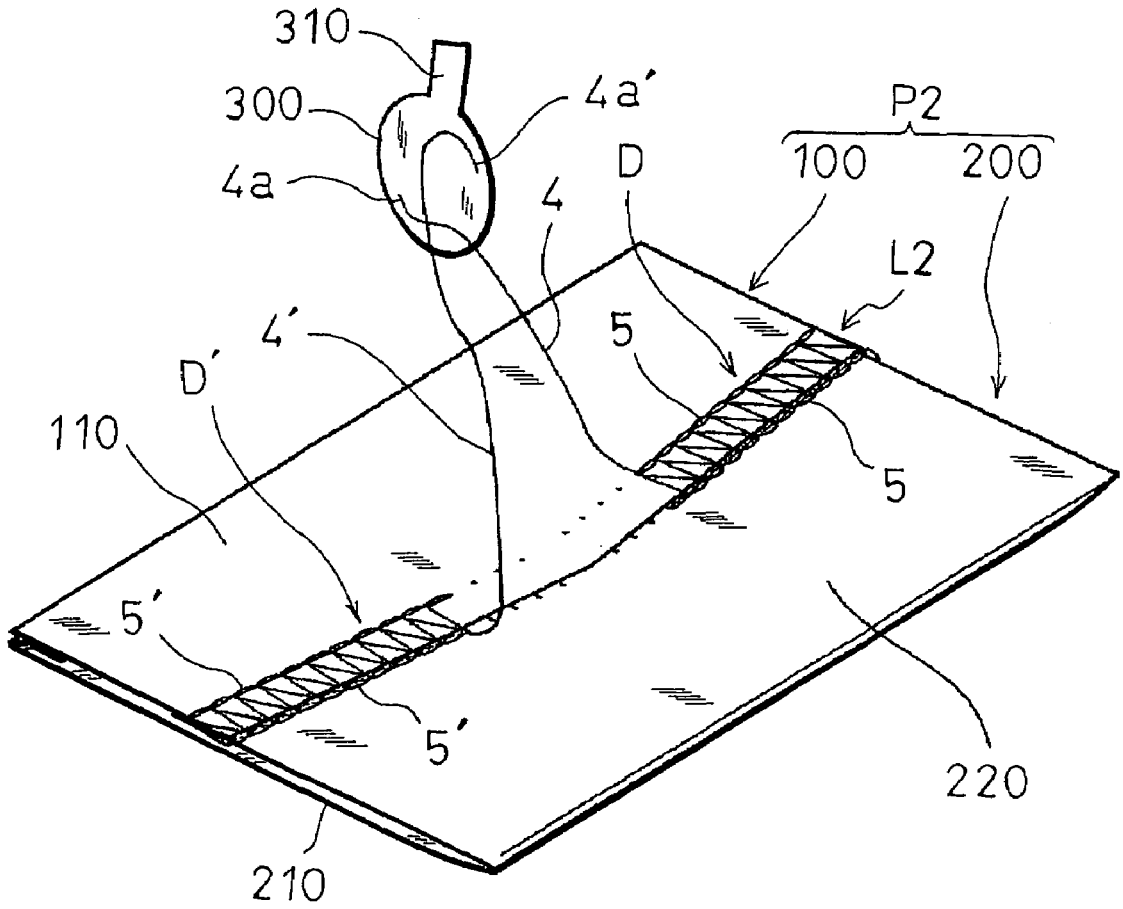
Figure 2:
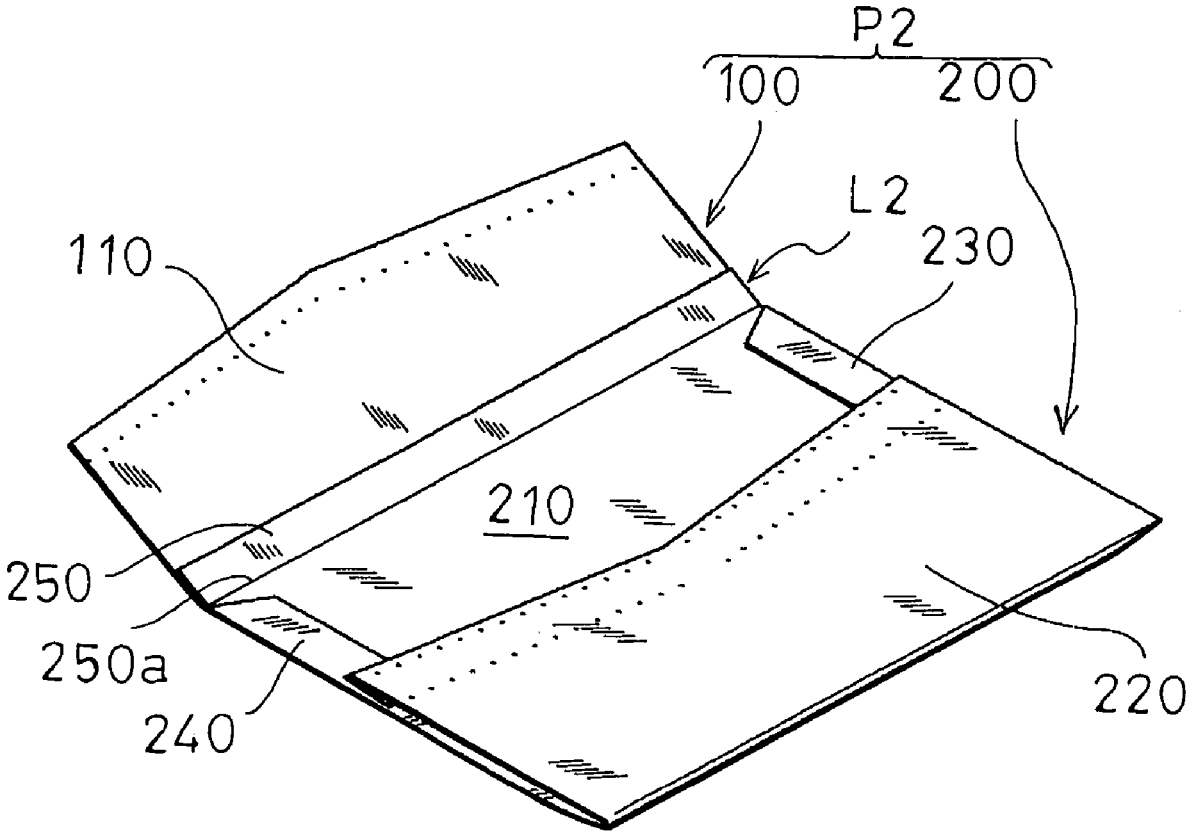

The foldable message card P1 is thus composed, in which illustration, message or the like can be freely printed or written by depending on application in arbitrary positions inside and outside of the card surfaces 11, 23 and card reverse side 21. When sending the foldable message card P1, as illustrated the spread state shown in FIG. 8 to the sealed state shown in FIG. 9, the right and left flaps 26, 27 is folded onto the card reverse side 21 by way of the folds 24, 25. Further, the card surfaces 11, 23 is folded on the card reverse side 21 by way of the fold 22, and the junction end 14 of the card surfaces 11, 23 is folded over the lower end outer surface side of the card reverse side 21 by way of the fold 12. Finally, by adhering and fixing by the adhering means 14, the double folded state is maintained as shown in FIG. 10 and FIG. 11, and the illustration or message provided in the inner surface of the card surfaces 11, 23 and card reverse side 21 can be concealed. Or, before adhering and fixing the junction end 14 to the lower end outer surface of the card reverse side 21, as shown in FIG. 9, the card object C can be contained, and this card object C can be also concealed. On the other hand, the recipient, as shown in FIG. 12, pulls the tab 31 of the ornament 30 adhered to the outer surface of the card surfaces 11, 23, and peels the ornament 30 from the outer surface of the card surfaces 11, 23, and pulls the looper thread 4 affixed to the sewing end portion 4*a* of the ornament 30, so that the stitching D of chain stitch unravels. As a result, the card surface half 11 of the first package body 10 and the card surface half 23 of the second package body 20 is separated, and it is opened as shown in FIG. 13, so that the spread state in FIG. 8 is reproduced. When opened, the illustration or message concealed in the inner surface of the card surfaces 11, 23 and card reverse side 21, and the card object C preliminarily contained and concealed can be revealed and seen.

Referring now to FIG. 14 to FIG. 20, another application example (an envelope sheet) of the sheet package body according to the present invention is explained.

This envelope sheet P2 is composed of a first package body 100 and a second package body 200. The second package body 200 includes a rectangular sheet reverse side 210, a sheet surface half 220, right and left junction ends 230, 240, a junction end 250, and right and left adhering means 270, 280. The sheet surface half 220 is linked to the upper edge of the sheet reverse side 210 by way of a fold 220*a*. The right and left junction ends 230, 240 are linked to the right and left edges of the sheet reverse side 210 by way of folds 230*a*, 240*a*. The junction end 250 is linked to the lower end of the sheet reverse side 210 by way of a fold 250*a*, and the outer surface of the junction end 250 has adhering means 260 formed by applying an adhesive agent or gluing a both-side adhesive tape. The right and left junction ends 270, 280 are disposed at right and left ends of the inner surface of the sheet surface half 220 at the intended adhering positions of the right and left junction ends 230, 240 by applying an adhesive agent or gluing a both-side adhesive tape. Meanwhile, the right and left adhering means 270, 280 maybe provided on the outer surface of the right and left junction ends 230, 240. The first package body 100 includes a sheet surface half 110. The lower end of the sheet surface half 110 of the first package body 100 and the upper end of the sheet surface half 220 of the second package body 200 are overlapped, and this overlapped portion L2 is sutured by the stitchings D, D' of chain stitch from the both ends (right and left ends in FIG. 14) toward the middle. As a result, the sutured sheet surface halves 110, 220 compose a sheet surface in a same shape as the sheet reverse side 210. In this preferred embodiment, sewing end portions 4*a*, 4*a*' of the looper threads 4, 4' cut off at the sewing end in the middle of the overlapped portion L2 project to the outer surface side of the overlapped portion L2. The sewing end portions 4*a*, 4*a*' of the looper threads 4, 4' are affixed to the adhering side of a seal-form ornament 300. This ornament 300 is adhered to the middle of the outer surface of the sheet surface, straddling over the sheet surface halves 110, 220 on the sewing end portion of the stitchings D, D' of chain stitch in the overlapped portion L2. Hence, the ornament 300 affixes the sewing end portions 4*a*, 4*a*' of the looper threads 4, 4' to the middle of the outer surface of the sheet surface. The ornament 300 also has a projecting tab 310 for peeling off the ornament not adhered to the outer surface of the sheet surface.

The envelope sheet P2 thus composed is sealed in the following procedure. In a spread state shown in FIG. 15, a letter or sheet object not shown is put on the sheet reverse side 210, and the right and left junction ends 230, 240 are folded down along the folds 230*a*, 240*a* on the sheet reverse side 210 from above the sheet object as shown in FIG. 16. The junction end 250 is folded by way of fold 250*a* on the sheet reverse side 210 from above the sheet object, and the sheet surface sides 110, 220 are folded along the folds 220*a* on the sheet reverse side 210 from above the sheet object. Finally, by the right and left adhering means 270, 280, the right and left junction ends 230, 240 are adhered and fixed to the right and left ends of the sheet surface sides 110, 220, and by the adhering means 260, the junction end 250 is fixed and adhered to the lower end of the sheet surface sides 110, 220. As a result, three free ends of the sheet reverse side 210 and sheet surface sides 110, 220, that is, the right and left ends and the lower end can be held. On the other hand, in the envelope sheet P2 in sealed state as shown in FIG. 17 and FIG. 18, by pulling the tab 310 of the ornament 300 adhered to the middle of the outer surface of the sheet surface sides 110, 220 as shown in FIG. 19, the ornament 300 is peeled off from the outer surface of the sheet surface sides 110, 220, and pulls the looper threads 4, 4' having the sewing end portions 4*a*, 4*a*' affixed to the ornament 300, and the right and left stitchings D, D' of chain stitch begin to unravel from each sewing end portion to the sewing start portion, that is, from the middle of the overlapped portion L2 to the right and left ends. In consequence, the overlapped portion L2 of the sheet surface half 110 of the first package body 100 and the sheet surface half 220 of the second package body 200 is separated, and the envelope is opened.

In the preferred embodiment, the first package body 1, 10, 100 and the second package body 2, 20, 200 are made of paper material, but not limited to this, various sewable materials may be used such as cloth fabric and film plastics. The stitchings D, D' of chain stitch are not limited to the stitch type 406 of JIS L 0120, may be formed in various stitch types such as 407, 602, 605, and 607 specified in the same standard.

In the preferred embodiment, only one tape member 3 is used, but by dividing it at the middle of the sheet package body P, the divided pair of right and left tape members may be extended excessively in the divided portion, and the stitchings of chain stitch may be formed on the pair of tape members. Thus, by tying the extended portions of the tape member, the tape member itself may be used as an ornament.

What is claimed is:

1. A sheet package body for packaging a solid object, comprising a first package body and a second package body, forming an overlapped portion characterized by overlapping a first paper material of said first package body and a second paper material of said second package body, in part, suturing the overlapped portion by stitching of a chain stitch before packaging the solid object, and cutting off the needle thread and looper thread at the sewing end of the stitching, wherein the overlapped portion is seperated by pulling said looper thread so as to reveal the solid object.

2. The sheet package body as defined in claim 1, wherein the overlapped portion is sutured with a tape material disposed at the lower side along said portion.

3. The sheet package body as defined in claim 1, wherein the end of the looper thread cut off at the sewing end of the stitching is decorated with an ornament.

4. The sheet package body as defined in claim 1, wherein the stitching is formed by engagement of two needle threads and a looper thread by using a double chain stitch sewing machine.

5. The sheet package body as defined in claim 1, wherein the overlapped portion is sutured from one end of the overlapped portion toward the other end by using a double chain stitch sewing machine.

6. The sheet package body as defined in claim 1, wherein the overlapped portion is sutured from both ends of the overlapped portion toward the middle by using a double chain stitch sewing machine.

7. The sheet package body as defined in claim 1, wherein the overlapped portion is sutured from one end of the overlapped portion toward the other end by using a double chain stitch sewing machine, and at the sewing end position sewing is once stopped, and the double chain stitch sewing machine is operated in a reverse rotation for one stitch, and the sewing is terminated by cutting off the needle thread and looper thread.

8. The sheet package body as defined in claim 1, wherein the overlapped portion is sutured from both ends of the overlapped portion toward the middle by using a double chain stitch sewing machine, and at the sewing end position, sewing is once stopped, and the double chain stitch sewing machine is operated in a reverse rotation for one stitch, and the sewing is terminated by cutting off the needle thread and looper thread.

9. The sheet package body as defined in claim 1, wherein at the sewing end portion of the stitching, the sewing end portion of the looper thread projects to the surface side.

10. A sheet package body for packaging a solid object, comprising a first package body and a second package body, forming a butted portion characterized by butting a first paper material of said first package body and a second paper material of said second package body against each other side to side, suturing said butted portion by stitching of a chain stitch so as to enclose by needle thread rows before packaging the solid object, and cutting off the needle threads and looper thread at the sewing end of the stitching, wherein the butted portion is separated by pulling said looper thread so as to reveal the solid object.

11. The sheet package body as defined in claim 10, wherein the butted portion is sutured with a tape material disposed at the lower side along said portion.

12. The sheet package body as defined in claim 10, wherein the end of the looper thread cut off at the sewing end of the stitching is decorated with an ornament.

13. The sheet package body as defined in claim 10, wherein the stitching is formed by engagement of two needle threads and a looper thread by using a double chain stitch sewing machine.

14. The sheet package body as defined in claim 10, wherein the butted portion is sutured from one end of the butted portion toward the other end by using a double chain stitch sewing machine.

15. The sheet package body as defined in claim 10, wherein the butted portion is sutured from both ends of the butted portion toward the middle by using a double chain stitch sewing machine.

16. The sheet package body as defined in claim 10, wherein the butted portion is sutured from one end of the butted portion toward the other end by using a double chain stitch sewing machine, and at the sewing end position sewing is once stopped, and the double chain stitch sewing machine is operated in a reverse rotation for one stitch, and the sewing is terminated by cutting off the needle thread and looper thread.

17. The sheet package body as defined in claim 10, wherein the butted portion is sutured from both ends of the butted portion toward the middle by using a double chain stitch sewing machine, and at the sewing end position, sewing is once stopped, and the double chain stitch sewing machine is operated in a reverse rotation for one stitch, and the sewing is terminated by cutting off the needle thread and looper thread.

18. The sheet package body as defined in claim 10, wherein at the sewing end portion of the stitching, the sewing end portion of the looper thread projects to the surface side.

* * * * *